United States Patent [19]

Olmr et al.

[11] Patent Number: 4,916,837

[45] Date of Patent: Apr. 17, 1990

[54] SINGLE STAGE SNOWTHROWER

[75] Inventors: Jaroslav J. Olmr, Rock Hill, S.C.; Robert D. Batting; John W. Hopkins, both of Charlotte, N.C.

[73] Assignee: Textron, Inc., Providence, R.I.

[21] Appl. No.: 224,907

[22] Filed: Jul. 27, 1988

Related U.S. Application Data

[63] Continuation-in-part of Ser. No. 75,433, Jul. 20, 1987, abandoned.

[51] Int. Cl.[4] ..... 0000 00/00

[52] U.S. Cl. ..... 37/252; 37/251

[58] Field of Search ..... 37/252, 251

[56] References Cited

U.S. PATENT DOCUMENTS

| | | | |
|---|---|---|---|
| 2,623,308 | 12/1952 | Lamy | 37/43 |
| 3,045,369 | 7/1962 | Howe | 37/252 |
| 3,078,603 | 2/1963 | Ertsgaard | 37/43 |
| 3,252,233 | 5/1966 | Simi | 37/43 |
| 3,253,356 | 5/1966 | Haban | 37/43 |

FOREIGN PATENT DOCUMENTS

| | | | |
|---|---|---|---|
| 0482078 | 3/1952 | Canada | 37/251 |

*Primary Examiner*—Edgar S. Burr
*Assistant Examiner*—Huong Q. Pham
*Attorney, Agent, or Firm*—Finnegan, Henderson, Farabow, Garrett & Dunner

[57] ABSTRACT

The invention is directed to a single stage snowthrower wherein a flat rear wall section of an impeller housing, a rear wall of a chute opening and the central axis of an external chute are all aligned to more efficiently remove snow. A gate is also provided to control the recirculation of snow through the impeller housing. The gate may comprise a sliding dam movable along a straight line into the housing. In a further embodiment of the present invention a pivotable dam is disposed between sidewalls of the impeller housing to vary the throat area into the chute opening in accordance with the wet or dry conditions of the snow.

6 Claims, 2 Drawing Sheets

SINGLE STAGE SNOWTHROWER

This application is a continuation-in-part of application Ser. No. 075,433 filed July 20, 1987, now abandoned.

BACKGROUND OF THE INVENTION

1. Field of the Invention

The present invention relates to single stage snowthrowers. More particularly, the present invention relates to a single stage snowthrower capable of more efficiently throwing snow than the prior art single stage snowthrowers.

2. Description of the Related Art

Typically a single stage snowthrower has a gas engine or electric motor mounted on an impeller housing containing a single impeller. The impeller may have axial vanes or vanes configured with a center paddle joined on each side to an helical auger end section. The housing contains a front opening for receiving snow. The snow entering the housing is then scooped up by the rapidly rotating vanes and hurled through a chute and out of the snowthrower.

A number of patents have issued describing single stage snowthrowers. U.S. Pat. No. 3,488,869 describes a snowthrower having a straight center paddle and auger end sections. European Patent Publication No. 214,923 dated Mar. 18, 1987 describes a single stage snowthrower with a curved center paddle and very short auger-like end sections.

U.S. Pat. No. 3,359,661 to Speiser et al. describes a unit in which an axial paddle ejects snow through a series of flexible vanes which are spaced axially above the impeller. This construction lacks the ability to throw snow long distances.

U.S. Pat. No. 3,253,356 to Haban describes a single stage snowthrower with a short center paddle and long auger end sections. A vertical round chute and complementary paddle is depicted.

Most single stage snowthrowers can handle dry snow well. On the other hand, wet and packed snow presents an almost insurmountable problem for most single stage snowthrowers. Efforts to remove wet or packed snow at a rapid rate will generally cause the snow to form an immovable plug within the exit chute which prevents further snow removal. In order to unclog the chute it must be stopped and the plug removed. The process is cumbersome, time consuming and at times, if done carelessly and negligently, dangerous.

Clogging is particularly acute where a long center paddle is used to concentrate the snow through the chute. If a curved paddle is used snow is thrown from both ends of the paddle at an angle to the main direction of movement, across the center line and against the walls of the chute thereby exagering the clogging phenomena.

SUMMARY OF THE INVENTION

Accordingly, it is an object of the present invention to provide a single stage snowthrower which avoids the disadvantages and limitations of prior art machines.

It is another object of the invention to provide a single stage snowthrower which can efficiently and reliably remove wet and packed snow.

It is yet another object of the invention to provide a snowthrower which is configured to minimize the buildup of snow inside the machine.

Still another object of the invention is to provide a single stage snowthrower having a variable throat area in the path of the snow between the impeller and the chute opening to thereby increase the efficiency of the throwing operation in both wet and dry snow.

Still another object of the invention is to provide a single stage snowthrower which includes an exit path that is configured in a predetermined manner to minimize the buildup of snow on the walls of the chute.

Still another object of the invention is to provide complementary and conforming housing, chute and paddle configurations to minimize clogging of snow in the chute during snow removal operations.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

In accordance with the present invention, there is provided a single stage snowthrower comprising: an impeller housing having a top wall and a front opening through which snow is ingested; a cylindrical wall section defining a lower bottom wall of the impeller housing; an impeller having a substantially flat central paddle section extending from a shaft mounted for rotation within the impeller housing; and spaced front and rear walls separated by end walls forming a chute opening in the top wall of the impeller housing. An external chute having a central axis positioned over the chute opening is disposed on the top wall of the housing. A flat transitional rear wall section joins the cylindrical wall section to the rear wall of the chute opening. The central paddle section includes outermost end portions bent rearwardly, relative to the direction of rotation of the impeller, from a radial line extending through the shaft such that the outermost end portions are disposed substantially perpendicularly to the transitional rear wall at the junction of the transitional rear wall section and the cylindrical wall section. This configuration of transitional rear wall, cylindrical lower bottom wall, and bent outermost end portions of the central paddle section results in a snowthrower having increased snow removal properties.

Preferably, the snowthrower includes a pivotable gate disposed between the sidewalls of the impeller housing to selectively adjust the area of the throat through which the thrown snow passes before exiting through the chute opening. The pivotable gate may be adjusted in accordance with the condition of the snow to minimize clogging in the chute opening.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DESCRIPTION OF THE PREFERRED EMBODIMENTS

Figure 1:
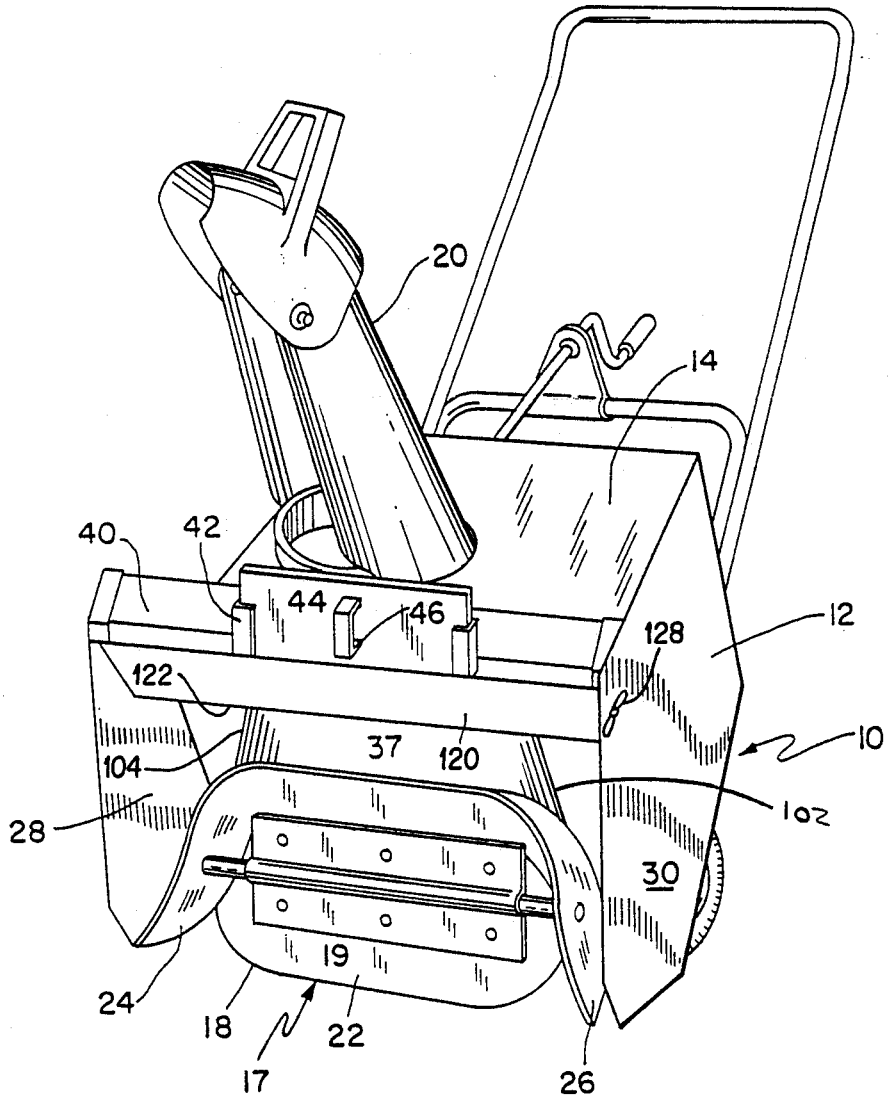
FIG. 1 is a perspective illustration of a single stage snowthrower embodying the principles of the present invention.

Reference will now be made in detail to the presently preferred embodiment and method of the invention as illustrated in the accompanying drawings, in which like reference characters designate like or corresponding parts throughout the several drawings.

Figure 2:
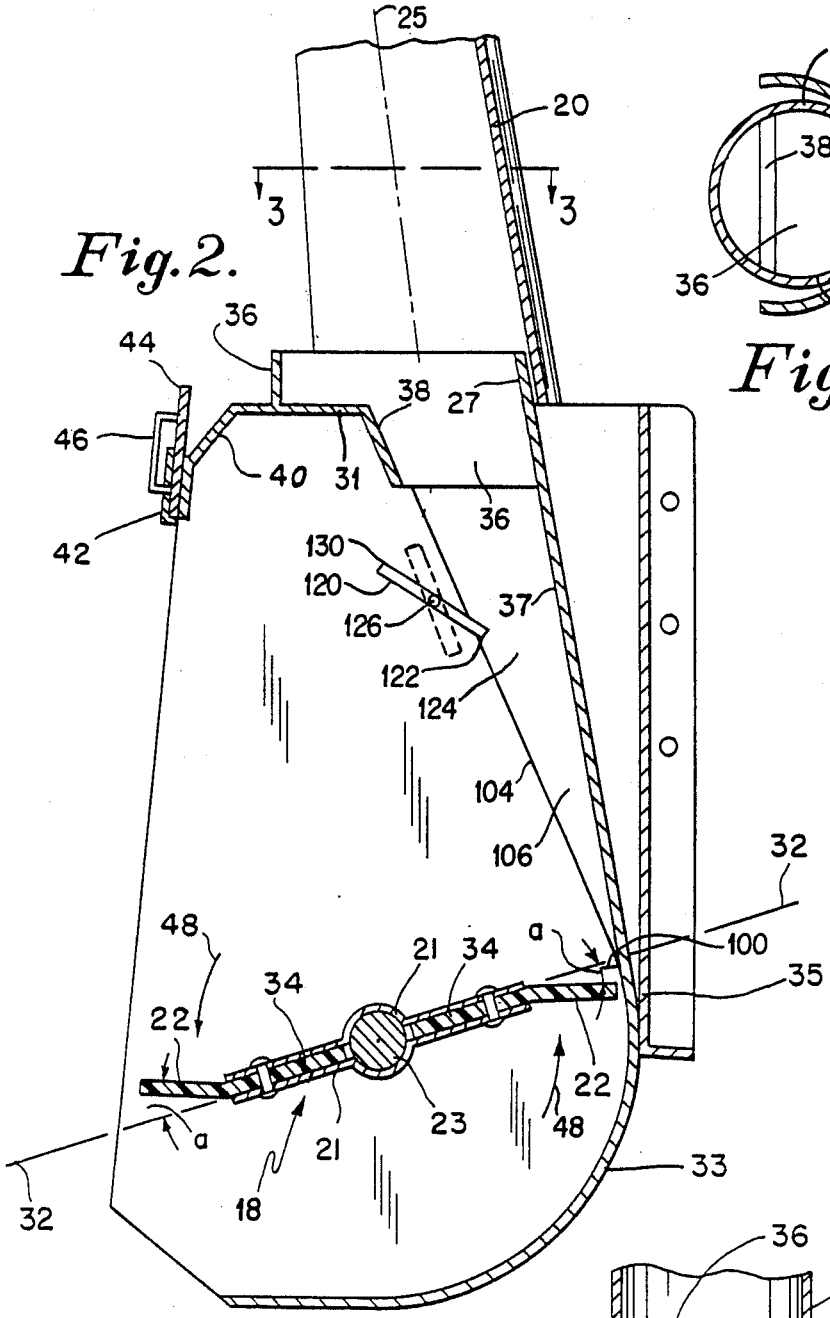
FIG. 2 is a sectional view taken along line 2—2 of FIG. 1.

Referring to FIGS. 1 and 2 there is shown a snowthrower 10 embodying the principles of the present invention. The snowthrower includes an impeller housing 12 having a first rear wall 27, side walls 28 and 30, a top wall 31, a generally cylindrical lower bottom wall 33, and a rear transitional wall 37 joining bottom wall 33 and rear wall 27. A rotatable impeller 18 is mounted on a shaft 23 extending between sidewalls 28 and 30. Impeller 18 includes two vanes 17 and is operatively connected to a means for rotating shaft 23 and impeller 18. As embodied herein, the rotating means may comprise a gas engine 14 drivably connected to shaft 23 by any conventional means.

An external chute 20 is disposed on the top of the housing 12 and communicates with the interior of housing 12 through a chute opening 36 disposed in top wall 31 for directing snow from the interior of the impeller housing 16 and away from the snowthrower 10. Chute opening 36 has a predetermined cross-sectional area and is substantially rectangular in shape as defined by rear wall 27, an opposing interior front wall 38, and end walls 39.

Impeller 18 is mounted in opposing end walls 28 and 30 by bearings (not shown) which enable the impeller to be rotated in the direction indicated by arrow 48 at the required speed by engine 14. Each vane 17 is preferably made from a single piece of flexible material 19 such as fiber reinforced rubber. Rubber piece 19 is bent into shape and secured to a central shaft 23 by two metal stampings 21. Impeller 18 includes two central paddle sections 34 situated 180 degrees apart, although the impeller is not limited thereto and may be configured with more than two paddle sections. Auger end sections 24 and 26 are disposed on each end of central paddle sections 34.

In accordance with the present invention, each outermost end portion 22 of central paddle sections 34 is bent rearwardly by a predetermined angle "a" relative to the direction of rotation of impeller 18, from a radial line 32 passing through a root of central paddle sections 34. The angle "a" may vary from zero to 15 degrees with 10 to 15 degrees being the preferred range. The precise amount of rearward bend of each outermost end portion 22 is determined such that each end portion 22 is disposed substantially perpendicularly to transitional rear wall 37 at the junction between transitional rear wall 37 and cylindrical bottom wall 33 as shown by right angle marks 100. The length of paddle section 34 is not critical but it will generally approach 50% of the length of the impeller to provide a good balance in snow handling ability with the auger end sections 24 and 26.

With continued reference to FIGS. 1 and 2 and in accordance with the present invention, housing 12 includes inwardly tapering interior side walls 102 and 104 extending from transitional rear wall 37 to define an exit path 106 for snow thrown from central sections 34 of impeller 18 up and through exit chute 106. Inwardly tapering interior side walls 102 and 104 terminate in respective edge portions which define an imaginary plane therebetween. Inwardly tapering interior sidewalls 102 and 104 in combination with rear transitional wall 37 and the imaginary plane between the edge portions of the interior side walls define exit path 106 of snow thrown into chute opening 36. Exit path 106 projects a cross-sectional area along its entire length which at all places is less than the predetermined cross-sectional area of chute opening 36. In this manner clogging of snow in chute opening 36 is minimized since the larger area of chute opening 36 permits an unimpeded flow of snow moving through exit path 106 into and through the chute opening.

Rear transitional wall 37 is planar and wide and generally co-extensive with the length of central paddle sections 34 at its lower edge. It narrows as it progresses upwardly between inwardly tapering interior side walls 102 and 104 to join with rear wall 27 of chute opening 36. Thus, rear wall 27 of chute opening 36 merges with the transitional rear wall 37 as shown in FIG. 3.

Figure 3:
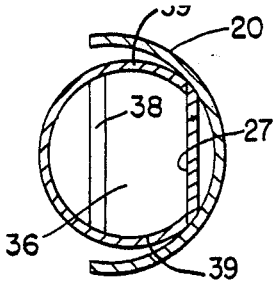
FIG. 3 is a sectional representation of the chute taken along lines 3—3 in FIG. 2.

External chute 20 is essentially semicircular as seen in FIG. 3. To provide the maximum unobstructed passage of snow through external chute 20, a central axis 25 of chute 20 is parallel to rear wall 27 and transitional rear wall 37. External chute 20 has a diameter which is larger than the diagonal of chute opening 36. The external chute 20 may be tapered inwardly as illustrated in FIG. 1 but at all times its radius is larger than the longest dimension, i.e., the diagonal, of chute opening 36 so that the snow passing through chute opening 36 will not pack within external chute 20.

Figure 4:
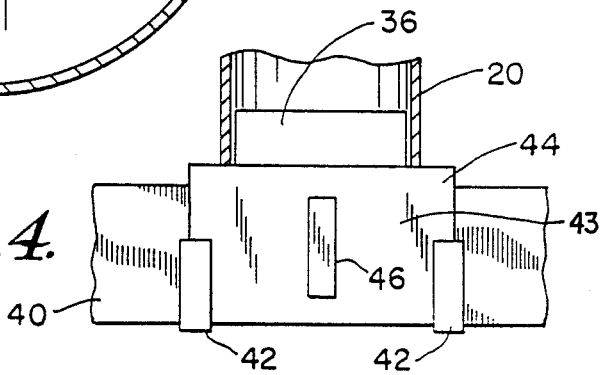
FIG. 4 is an enlarged representation of a portion of the top of the impeller housing.

In accordance with the present invention snowthrower housing 12 includes an exterior front wall 40 extending from top wall 31 and spaced forwardly from interior front wall 38. A reciprocally movable gate or snow dam 44 is mounted on exterior front wall 40. With reference to FIG. 4, reciprocally movable gate 44 includes a substantially rectangular plate 43 held in channels 42. Plate 43 of gate 44 is selectively movable into and out of the top portion of the front opening of impeller housing 12 to adjust the volume of snow being recirculated through the upper portion of the front opening in accordance with the condition of snow being thrown. Such recirculation or spillage is inherent in all single stage snowthrowers and is required for efficient operation and use of a single stage snowthrower since it provides a means for metering the amount of snow being thrown by the impeller in accordance with the depth of the snow, the condition of the snow, i.e., whether wet or dry or some mixture of both, and the operating characteristics of the impeller and the prime mover of the snowthrower. Movable gate or snow dam 44 includes a handle 46 extending from rectangular plate 43 for adjustment of the position of rectangular plate 43 relative to exterior front wall 44. Handle 46 may be gripped by the operator to move rectangular plate 43 within channels 42 to thereby move rectangular plate 43 to whatever position is required in accordance with the condition of the snow. In dry snow conditions rectangular plate 43 is moved downwardly as seen in FIG. 2 to cover more of the top portion of the front opening of impeller housing 12 and less snow is recirculated through the front opening of the impeller housing. In contrast, for wet snow conditions rectangular plate 43 is moved to a fully retracted position, i.e., upwardly in FIG. 2, and more snow is recirculated through the top portion of the front opening of impeller housing 12.

In accordance with the present invention, snowthrower 10 may also be equipped with a pivotable gate 120 having a bottom end 122 mounted between sidewalls 28 and 30 and spaced from back wall 37 to define a variable throat area 124 below chute opening 36. Pivotable gate 120 is pivotable about an axis defined by a shaft 126. Shaft 126 is substantially parallel to back wall 37 and mounted in sidewalls 28 and 30. With reference to FIG. 1, a butterfly type hinge or any other type of manual actuating device extends from shaft 126 on the outside of sidewall 30. Pivotable gate 120 is adjusted by manually rotating butterfly hinge 128 to vary the distance between bottom end 122 of pivotable gate 120 and back wall 37 of impeller housing 12 to thereby selectively adjust the cross-sectional area of the throat 124 in accordance with the condition of the snow being thrown by impeller 18.

When the condition of the snow being thrown is relatively wet, that is having a high moisture content, bottom end 122 of pivotable gate 120 is moved closer to rear transitional wall 37 to thereby decrease the cross-sectional area of throat 124. In this manner less of the wet snow which has a tendency to pack in chute opening 36 is moved through the exit path defined by throat area 124 to minimize the potential for clogging in chute 36. In dry snow conditions pivotable gate 120 may be rotated to the position shown by dotted lines in FIG. 2 to thereby increase cross-sectional area of throat 124. In this manner pivotable gate 120 acts as a second snow dam to meter the amount of snow passing through chute opening 36.

The relatively simple construction of pivotable gate 120 provides the advantage of decreasing the cost of the snowthrower and provides the further advantage of easy manipulation of pivotable gate 120 for either dry or wet snow conditions. Moreover, by decreasing the cross-sectional area of throat 124 a venturi-type effect is created which accelerates the large volumes of dry snow or wet snow being passed through throat 124 to thereby increase the overall efficiency of the snow-throwing operation. Furthermore, the configuration of pivotable gate 120 as described above provides a solid construction with no loose parts which may be shaken and displaced due to the vibrations inherent in the operation of a single stage snowthrower, thus increasing the safety factor of the operation of the snowthrower.

The embodiment of pivotable gate 120 described above positions shaft 126 and at intermediate point between bottom end 122 and a top end 130 of pivotable gate 120. However, the present invention is not limited to such configuration and pivotable gate 120 may also be pivoted about a shaft disposed substantially adjacent top end 130. Furthermore, shaft 126 may be disposed at any intermediate position between bottom end 122 and top end 130 of pivotable gate 120.

The operation of the snowthrower incorporating the teachings of the present invention will now be described. Impeller 18 is driven at high speed in the direction of arrow 48 as shown in FIG. 2. At the same time the snowthrower is pushed forward to ingest snow. The snow entering through the front of the impeller housing is picked up by vanes 17, rotated rearwardly within the housing and translated through exit path 106, out of chute opening 36, and through the external chute 20 away from the snowthrower.

A portion of the snow entering the impeller housing is captured by central paddle sections 22 and a portion is captured by auger end sections 24 and 26 and fed to central paddle sections 34. Because chute opening 36 has a larger cross-sectional area than the cross-sectional area of exit path 106, snow is efficiently moved out of housing 12 with a minimum amount of clogging.

Efficiency of performance is directly related to volume of snow that may be removed per unit of time. Single stage snowthrowers incorporating the teachings of the present invention are very efficient in the removal of snow for at least the following reasons. One of outermost end portions 22 of central paddle sections 34 is shown at a junction 35 of the cylindrical bottom wall section 33 and the lower edge of transitional rear wall section 37. Because each outermost end portion 22 is bent to conform to a right angle relative to wall section 37 at this point, snow is thrown by central paddle section 34 in a direction substantially parallel to wall section 37. When an object is released from a rotating surface it flys off and follows a tangential trajectory from the point it is released. In this case the snow leaves the paddle at the precise moment the paddle is at a right angle to rear wall 37. The snow leaving the paddle is therefore displaced substantially parallel to the rear wall sections 27 and 37 as well as interior front wall 38.

The snow also travels essentially parallel to the circular wall portions 39 of chute opening 36 which define the short legs of the chute opening. At this point in time none of the snow leaving the paddle 22 is moving toward a wall section. There is therefore little or no tendency for the snow to build up on the rear wall section 37 or interior side walls 102 and 104 as an incipient plug. Excess snow is diverted by interior front wall 38 and either exits the front of the impeller housing as spillage or is recirculated directly back onto impeller 18.

Further, since the paddle 22 is flat there is little or no snow thrown laterally. The snow moving toward the center tends to be picked up by the fast moving axially directed snow and consolidated therewith and redirected in a direction parallel to rear wall sections 27 and 37 thus further minimizing the danger of plugging in chute 36.

In heavy, wet snow the auger speed is reduced due to the heavy engine load. This reduces the distance the snow is thrown and also makes it easier to plug the chute opening in the impeller housing. By leaving reciprocally movable gate 44 in its raised position more snow is permitted to fly forward of the housing and there is less recirculation of the snow and the load is thereby lightened. The likelihood of chute opening 36 plugging is thereby reduced.

In dry powder snow reciprocally movable gate 44 may be lowered to intercept snow which would normally be thrown out of the front of the housing as spillage. The recirculation is increased and the efficiency of the snowthrower is thereby also increased without danger of plugging.

Additional advantages and modifications will readily occur to those skilled in the art. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. A single stage snowthrower, comprising:

an impeller housing having a top wall, opposing side walls and a front opening through which snow is ingested;

a cylindrical wall section defining a lower bottom wall of said impeller housing;

an impeller having a substantially flat central paddle section extending from a shaft mounted for rotation within said impeller housing, said impeller extending across a substantial portion of said impeller housing;

spaced front and rear walls separated by end walls forming a chute opening in said top wall of said impeller housing, said chute opening having a predetermined cross-sectional area;

an external chute having a central axis positioned over said chute opening;

a flat transitional rear wall section joining said cylindrical wall section to said rear wall of said chute opening, said central paddle section having outermost end portions bent rearwardly, relative to the direction of rotation of said impeller, from a radial line extending through said shaft such that said outermost end portions are disposed substantially perpendicularly to said transitional rear wall at the junction of said transitional rear wall section and said cylindrical wall section; and a pivotable gate, having a bottom end, mounted between said sidewalls and spaced from said rear walls to define a variable throat area below said chute opening through which snow thrown by said impeller passes, said gate being pivotable about an axis substantially parallel to said rear walls to vary the distance between said bottom end of said gate and said rear walls to thereby selectively adjust said throat area in accordance with the condition of the snow being thrown by said impeller.

2. A single stage snowthrower, comprising:

an impeller housing having a top wall, opposing side walls and a front opening through which snow is ingested;

a cylindrical wall section defining a lower bottom wall of said impeller housing;

an impeller having a substantially flat central paddle section extending from a shaft mounted for rotation within said impeller housing, said impeller extending across a substantial portion of said impeller housing:

spaced front and rear walls separated by end walls forming a chute opening in said top wall of said impeller housing, said chute opening having a predetermined cross-sectional area;

an external chute having a central axis positioned over said chute opening;

a flat transitional rear wall section joining said cylindrical wall section to said rear wall of said chute opening; and a pair of inwardly tapering interior sidewalls extending outwardly from said flat transitional rear wall section and extending upwardly to blend with said chute opening, said interior side walls terminating outwardly from said transitional rear wall section at respective edges thereof, said inwardly tapering sidewalls in combination with said flat transitional rear wall section and an imaginary plane extending between said edges of said inwardly tapering sidewalls defining an exit path through which snow is thrown by said central paddle section, said exit path having a cross-sectional area along its entire length which at all places is less than said predetermined cross-sectional area of said chute opening.

3. A snowthrower, comprising:

an impeller housing having a top wall, a back wall, spaced sidewalls, and a cylindrical bottom wall defining a front opening into said housing, said top wall having a chute opening therein;

an impeller rotatably mounted between said sidewalls and extending across a substantial portion of said impeller housing, and means for rotating said impeller to direct snow upwardly and through said chute opening; means for recirculating a portion of the snow engaged and thrown by said impeller through an upper portion of said front opening, the area of said upper portion being substantial less than the entire area of said front opening;

means for adjusting the volume of the snow which is recirculated, said adjusting means including a reciprocally movable gate mounted proximate said top wall of said housing, said gate being selectively movable into and out of said upper portion of said front opening to adjust the volume of snow being recirculated through said upper portion of said front opening in accordance with the condition of the snow being thrown.

4. A snowthrower, comprising:

an impeller housing having a top wall, a back wall, and spaced sidewalls defining a front opening into said housing, said top wall having a chute opening therein;

an impeller rotatably mounted between said side walls and extending across a substantial portion of said impeller housing, and means for rotating said impeller to throw snow upwardly and through said chute opening;

a pivotable gate, having a bottom end, mounted between said sidewalls and spaced from said backwall to define a variable throat area below said chute opening through which snow thrown by said impeller passes, said gate being pivotable about an axis substantially parallel to said back wall to selectively position said bottom end of said gate relative to said backwall and thereby adjust said throat area in accordance with the condition of the snow being thrown by said impeller, said bottom end of said gate remaining fixed relative to said back wall as snow is thrown through said chute opening.

5. The snowthrower as defined in claim 4, wherein said gate is configured as a rectangular plate having a top end opposite said bottom end, said pivot axis of said gate being substantially contiguous with said top end.

6. A snowthrower as defined in claim 4, wherein said gate is configured as a rectangular plate having a top end opposite said bottom end, said pivot axis of said gate being disposed between said top end and said bottom end of said rectangular plate.

* * * * *